US006895948B2

(12) United States Patent
Mori et al.

(10) Patent No.: US 6,895,948 B2
(45) Date of Patent: May 24, 2005

(54) EXHAUST GAS RECIRCULATION SYSTEM FOR INTERNAL COMBUSTION ENGINE

(75) Inventors: Michihiro Mori, Ohbu (JP); Hironori Tanikawa, Ohbu (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/687,698

(22) Filed: Oct. 20, 2003

(65) Prior Publication Data

US 2004/0079348 A1 Apr. 29, 2004

(30) Foreign Application Priority Data

Oct. 21, 2002 (JP) ..... 2002-305529

(51) Int. Cl.[7] ..... F02M 25/07; F02M 35/10
(52) U.S. Cl. ..... 123/568.17; 123/184.21
(58) Field of Search ..... 123/568.11, 568.17, 123/568.18, 184.21, 184.61

(56) References Cited

U.S. PATENT DOCUMENTS 4,693,226 A * 9/1987 Choma ..... 123/568.17
4,867,109 A * 9/1989 Tezuka et al. ..... 123/568.17
5,666,930 A * 9/1997 Elder ..... 123/568.17
6,772,729 B2 * 8/2004 Brosseau et al. ..... 123/568.17

FOREIGN PATENT DOCUMENTS

JP 20008968 1/2000

* cited by examiner

*Primary Examiner*—Willis R. Wolfe, Jr.
(74) *Attorney, Agent, or Firm*—Stevens, Davis, Miller & Mosher, LLP

(57) ABSTRACT

An exhaust gas recirculation system for an internal combustion engine in which at least one metal plate is interposed between a cylinder head and an intake manifold, and an EGR gas passage is formed in the plate, wherein the EGR gas passage is formed in its lowest portion with an EGR gas outlet port communicated with an intake passage formed in the plate, so as to prevent condensed water from steam in the EGR gas from collecting within the EGR gas passage, thereby preventing corrosion of the plate.

8 Claims, 9 Drawing Sheets

FIG. 8A
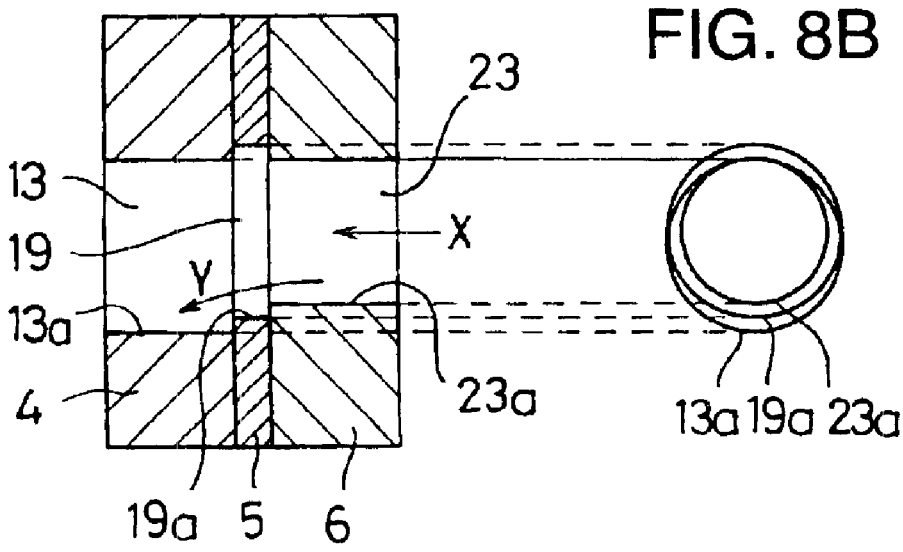
FIG. 8B
FIG. 9A
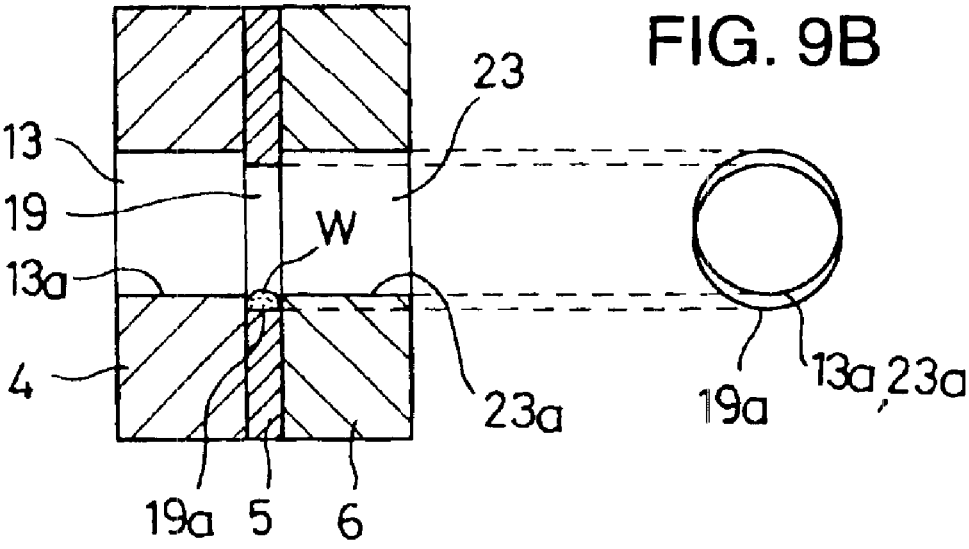
FIG. 9B

EXHAUST GAS RECIRCULATION SYSTEM FOR INTERNAL COMBUSTION ENGINE

BACKGROUND OF THE INVENTION

1. Field of the Invention

The present invention relates to an exhaust gas recirculation system (EGR system) for an internal combustion engine.

2. Description of the Related Art

In general an exhaust gas recirculation system for an internal combustion engine has such a configuration that EGR gas to be recirculated is extracted from an exhaust port in a cylinder head and is led into an intake passage, downstream of a throttle valve, by way of an EGR valve.

In the exhaust gas recirculation system having the above-mentioned configuration, when an intake manifold is made of resin, for preventing thermal deformation of the resin manifold caused by EGR gas at a high temperature, a metal spacer (plate) is interposed between the resin intake manifold and the cylinder head of the engine, and an EGR gas passage is formed in the spacer portion.

As a conventional structure forming the EGR gas in the spacer portion, as shown in FIG. 12, an EGR branch passage 102 which is recessed in a spacer 101 and through which EGR gas flows upward is disclosed, for example, in JP-A-2000-8968.

As the above-mentioned conventional exhaust gas recirculation system, in the configuration that the EGR branch passage 102 in the spacer 101 is curved downward in a state of installation, condensed water from steam in EGR gas collects at a bottom portion 103 of the EGR branch passage 102, and there would be caused a risk of corrosion of the spacer 101 due to aging effect since the condensed water is acid.

SUMMARY OF THE INVENTION

Accordingly, it is an object of the present invention to provide an exhaust gas recirculation system for an internal combustion engine which can solve the above-mentioned problems.

In order to solve the above problems, according to the present invention, there is provided an exhaust gas recirculation system for an internal combustion engine, in which at least a metal plate is interposed between a cylinder head and a intake manifold made of resin, and an EGR gas passage is formed in the plate, characterized in that:

an EGR gas outlet port communicated to an intake passage formed in the plate is provided and located at the lowest portion in the EGR gas passage formed in the plate.

With this configuration according to the present invention, when condensed water from steam in EGR gas attaches to the EGR gas passage formed in the plate, the condensed water flows down to the lowest portion of the EGR gas passage, due to the stream of the EGR gas, and is then discharged into the intake passage through the EGR outlet port formed in the above lowest portion. Thereby it is possible to prevent the condensed water from collecting in the EGR gas passage.

In the present invention, further, the bottom surface of the EGR gas passage may be formed therein with an inclined surface which slopes downward to the side where the EGR gas outlet port is located, in the for and aft direction of the plate.

With the above configuration, the condensed water in the EGR gas passage can be led into the EGR gas outlet port even though the plate is inclined in its for and aft direction when the plate is attached to the cylinder head, thereby it is possible to surely discharge the condensed water.

BRIEF DESCRIPTION OF THE DRAWINGS

FIG. 8A is a sectional view taken along a line VIIIA—VIIIA in FIG. 2, and FIG. 8B is a view showing a relationship between bore diameters thereof;

FIG. 9A is a reference sectional view illustrating a structure shown in FIG. 8A, and FIG. 9B is a view illustrating relationship between bore diameters thereof;

DESCRIPTION OF THE PREFERRED EMBODIMENT

Explanation will be hereinbelow made of preferred embodiments according to the present invention with reference to FIGS. 1 to 11.

FIGS. 1 to 8 show a first embodiment according to the present invention.

Figure 1:
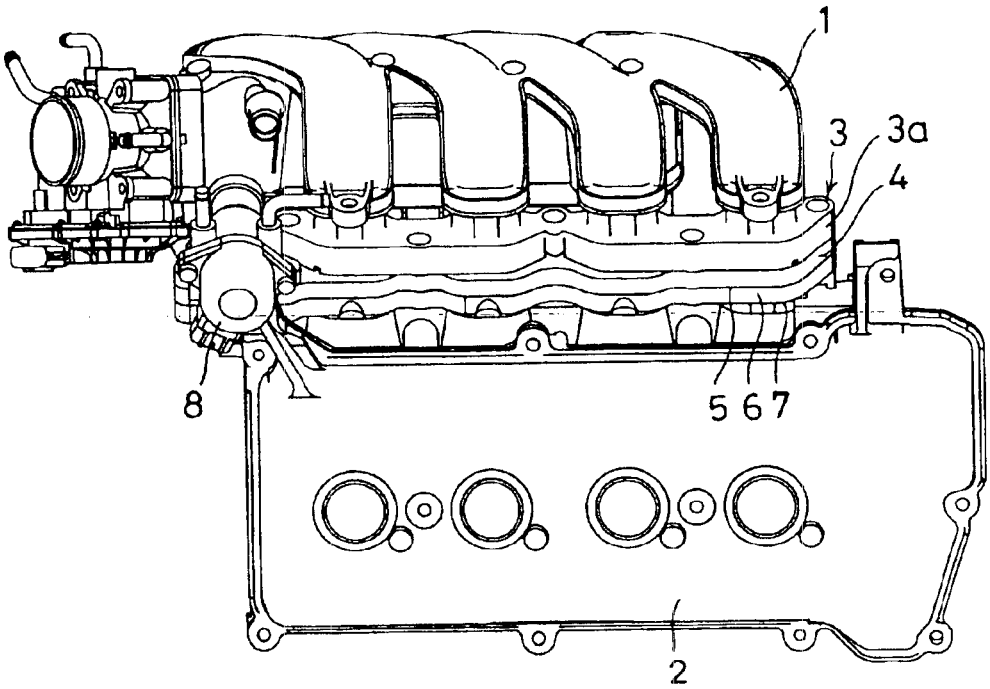
FIG. 1 is a plan view illustrating an internal combustion engine incorporating an exhaust gas recirculation system according to a first embodiment of the present invention.

Referring to FIG. 1 which is a plan view illustrating an internal combustion engine incorporating an exhaust gas recirculation system according to the present invention, an intake manifold 3 made of resin, a first plate 4 made of metal, a first metal gasket 5, a second plate 6 made of metal and a second metal gasket 7 are interposed between intake tube portions 1 and a cylinder head 2 of the engine, in the mentioned order. There is also shown an EGR valve 8 in this drawing.

Detailed explanation will be made of the components as mentioned above with reference to FIGS. 2 to 8B.

The resin intake manifold 3 has a flange portion 3*a* which is formed in a sidewise long shape so as to have four intake passages 9 for cylinders in a multi-cylinder engine, that is, four cylinders as shown in the drawing, and the intake passages 9 are communicated, on the front surface 3*b* side, with the intake tube portions 1 by means of coupling potions 10, and are opened on the rear surface 3*c* side.

The above-mentioned first plate 4 is formed so as to have its outer periphery which defines a shape coincident with the outer peripheral shape of the flange 3*a* of the above-intake manifold 3, and is formed therein with four intake passages 11, piercing therethrough and opened to both front surface 4*a* and rear surface 4*b* thereof, at the positions of the intake air passages 9. Further, the first plate 4 is formed thereon with a mounting portion 4*c* for the EGR valve 8 on one end side. Further, the above-mentioned EGR valve 8 is mounted on the mounting portion 4*c* on the front surface 4*a* side through the intermediary of a third metal gasket 12.

Figure 5:
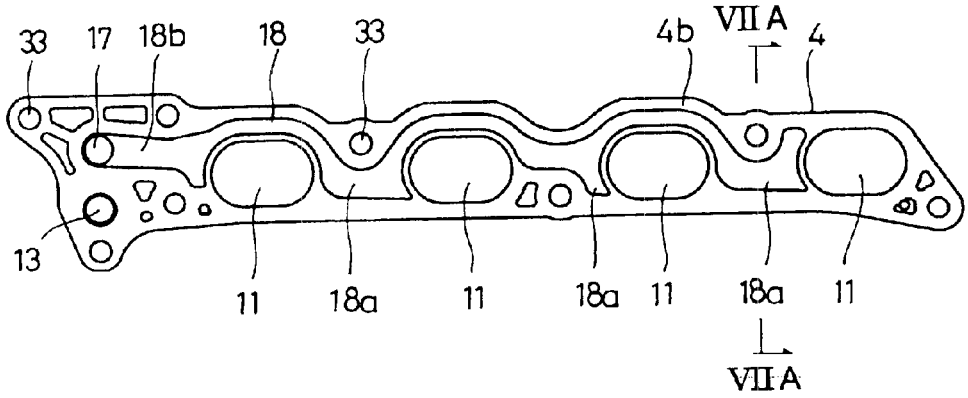
FIG. 5 is a rear view of the first plate shown in FIG. 4A.

Further, the first plate 4 is formed therein with an EGR gas inflow passage 13 which pierces therethrough, and the third metal gasket 12 is formed therein an EGR gas inflow passage 14 which pierces therethrough, which are located at a position where it aligns with an EGR gas inflow passage 15 formed in the EGR gas valve 8. Further, the EGR gas valve 8 is formed therein with an EGR gas outflow passage 16 while the third metal gasket 12 is formed therein with an EGR gas outflow passage 14*a* which pierces therethrough, and the first plate 4 is formed therein an EGR gas intake port 17 on the front surface 4*a* side, as shown in FIG. 5, which are located at a position where these passages are aligned with one another.

Figure 7A:
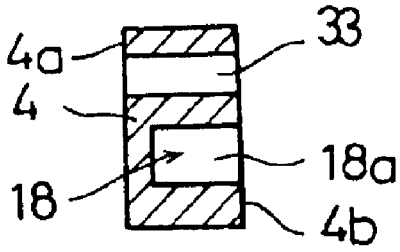
FIG. 7A is a sectional view taken along a line VIIA—VIIA in FIG. 5.

The above-mentioned first plate 4 is formed therein with a continuous EGR gas passage 18 on its rear surface 4*b* side, leaving the wall part by which the four intake passages 11 are defined, thus, the EGR passage 18 extending along by the intake passages 11 laterally in the plate 4. As shown in FIG. 7A, the EGR gas passage 18 is a blind groove which is not opened at its front surface 4*a* side but is opened at its rear surface 4*b* side, and is formed therein with recesses 18*a* which descend between the intake passages 11. Further, the EGR gas passage 18 is formed at its one end with an EGR gas intake passage 18*b* through which the EGR gas passage 18 is communicated with the above-mentioned EGR gas intake passage 17. The EGR gas intake passage 18*b* is formed, as shown in FIG. 5, by being inclined so that the portion on the EGR gas intake passage 17 side is located at an upper position.

The above-mentioned second metal gasket 5 has an outer peripheral shape which is coincident with the outer peripheral shape of the first plate 4, and is formed therein with a communication hole 19 aligned with the EGR gas inflow passage 13 formed in the first plate 4, communication bores 20 aligned with the intake passages 11, and a communication aperture 21 aligned with the EGR gas passage 18, and a communication aperture 22 aligned with the EGR gas intake passage 18*b*, these communication hole, bore and apertures piercing through the second metal gasket 5 so as to extend from the front surface to the rear surface thereof.

The second plate 6 has an outer periphery which defines a shape coincident with the outer peripheral shape of the first plate 4, and is formed therein with an EGR gas inflow passage 23 which is aligned with the EGR gas inflow passage 13 formed in the first plate 4 and with the communication hole 19 formed in the first metal gasket 5, and is also formed therein with intake passages 24 aligned with the intake passages 11 formed in the first plate 4 and with the communication bores 20 formed in the first metal gasket 5, the intake passages 24 piercing through the second plate 6 so as to extend from the front surface to the rear surface thereof.

Figure 6:
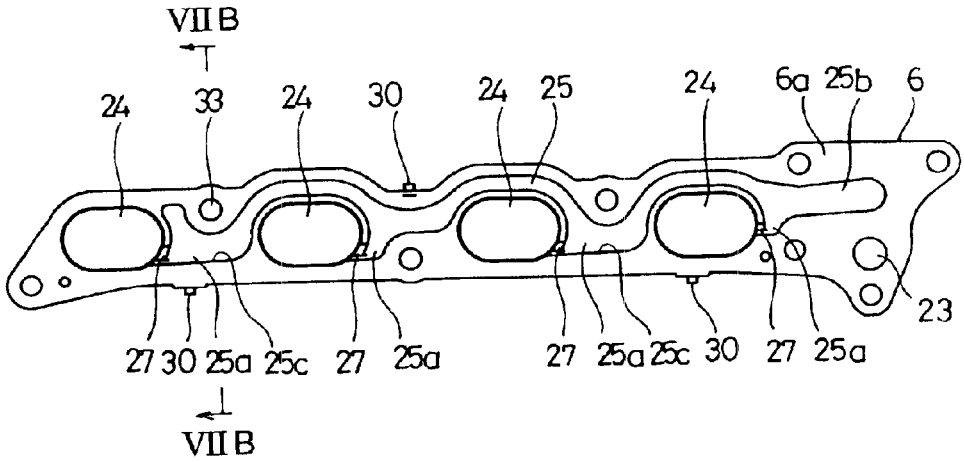
FIG. 6 is a front view of the second plate shown in FIG. 4B.
Figure 7B:
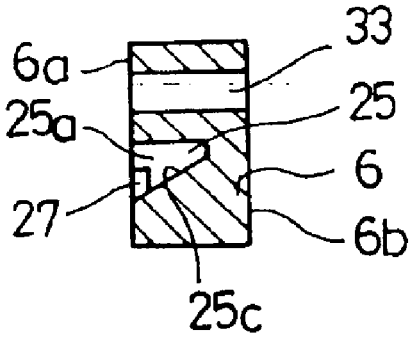
FIG. 7B is a sectional view taken along a line VIIB—VIIB in FIG. 6.

Further, as shown in FIG. 6, the second plate 6 is formed therein with an EGR gas passage 25 and an EGR gas intake passage 25*b* on the front surface 6*a* side, which have shapes coincident respectively with the EGR gas passage 18 and the EGR gas intake passage 18*b* formed in the first plate 4 and with communication apertures 21, 22 formed in the first metal gasket 5. The EGR gas passage 25 and the EGR gas intake passage 25*b* are grooves which are opened on the front surface 6*a* side facing the first metal gasket 5, but are not opened at the rear surface side 6*b*, as shown in FIG. 7B.

The EGR gas passage 25 in the second plate 6 is formed therein with recesses 25*a* similar to the recesses 18*a* in the EGR gas passage 18 in the first plate 4, and each of these recesses 25*a* is formed at the lowest portion with an EGR gas outlet port 27 which is communicated with one of the intake passages 24, respectively.

Figure 7C:
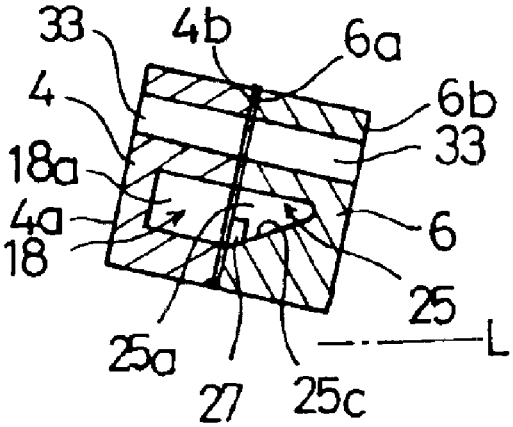
FIG. 7C is a sectional view illustrating the plates shown in FIGS. 7A and 7B are superposed each other in a state of installation.

Further, each of the recesses 25*a* has the bottom surface 25*c* which is inclined downward toward the front surface 6*a*. Further, the bottom surface 25*c* has an inclination angle which is set so that the bottom surface 25*c* is inclined downward to the front surface 6*a* side with respect to a horizontal plane L even though the first plate 4 is mounted to the engine, being inclined, as shown in FIGS. 1 and 7C. Further, each of the EGR gas outlet ports 27 is formed in one of the bottom surfaces 25*c* on the front surface 6*a* side where it becomes the lowest position.

The above-mentioned second metal gasket 7 has its outer periphery having a shape coincident with the outer periphery of the second plate 6, and is formed therein with a communication hole 28 aligned with the EGR gas inflow passage 23 formed in the second plate 6, and communication bores 29 aligned with the intake passages 24, the communication hole and bores piercing through the second metal gasket so as to extend from the front surface to the rear surface thereof.

Figure 2:
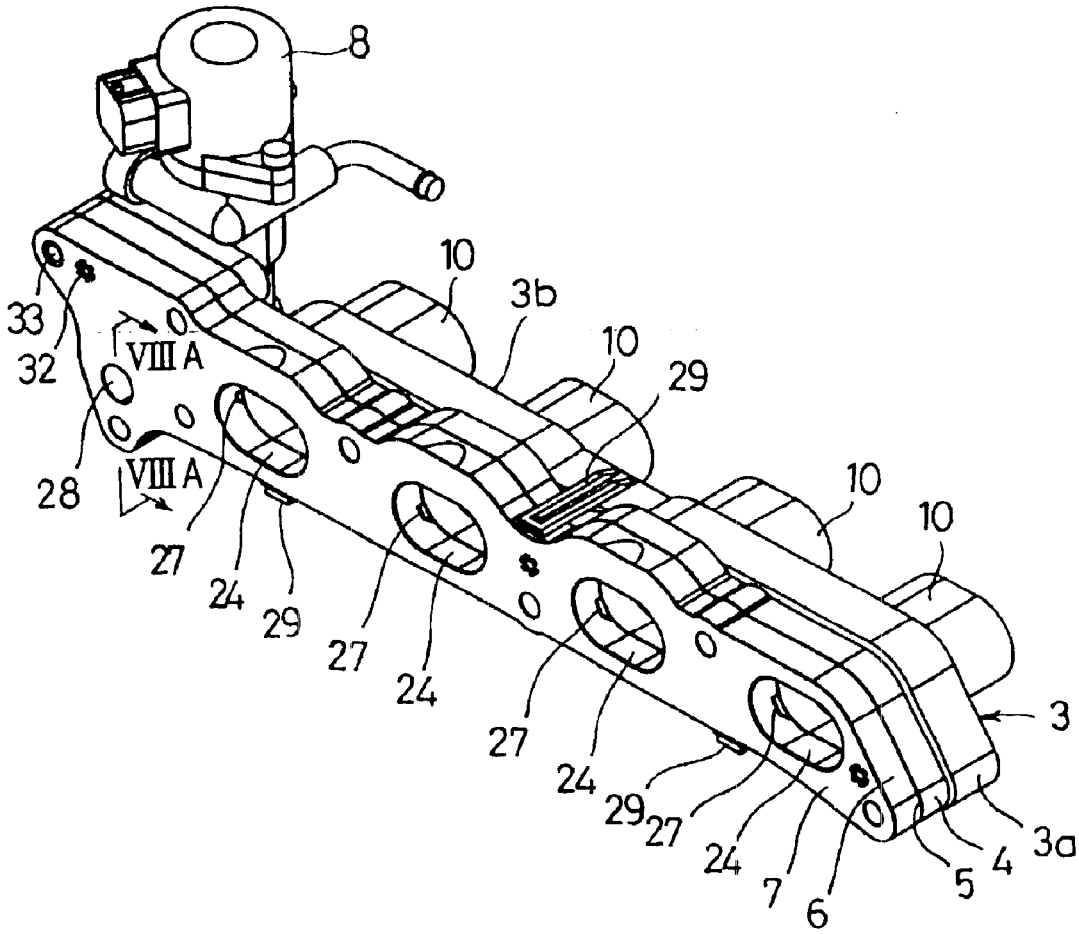
FIG. 2 is a perspective view illustrating a condition in which an intake manifold, a plate and a gasket shown in FIG. 1 are superposed with one another and are temporarily fixed.
Figure 3:
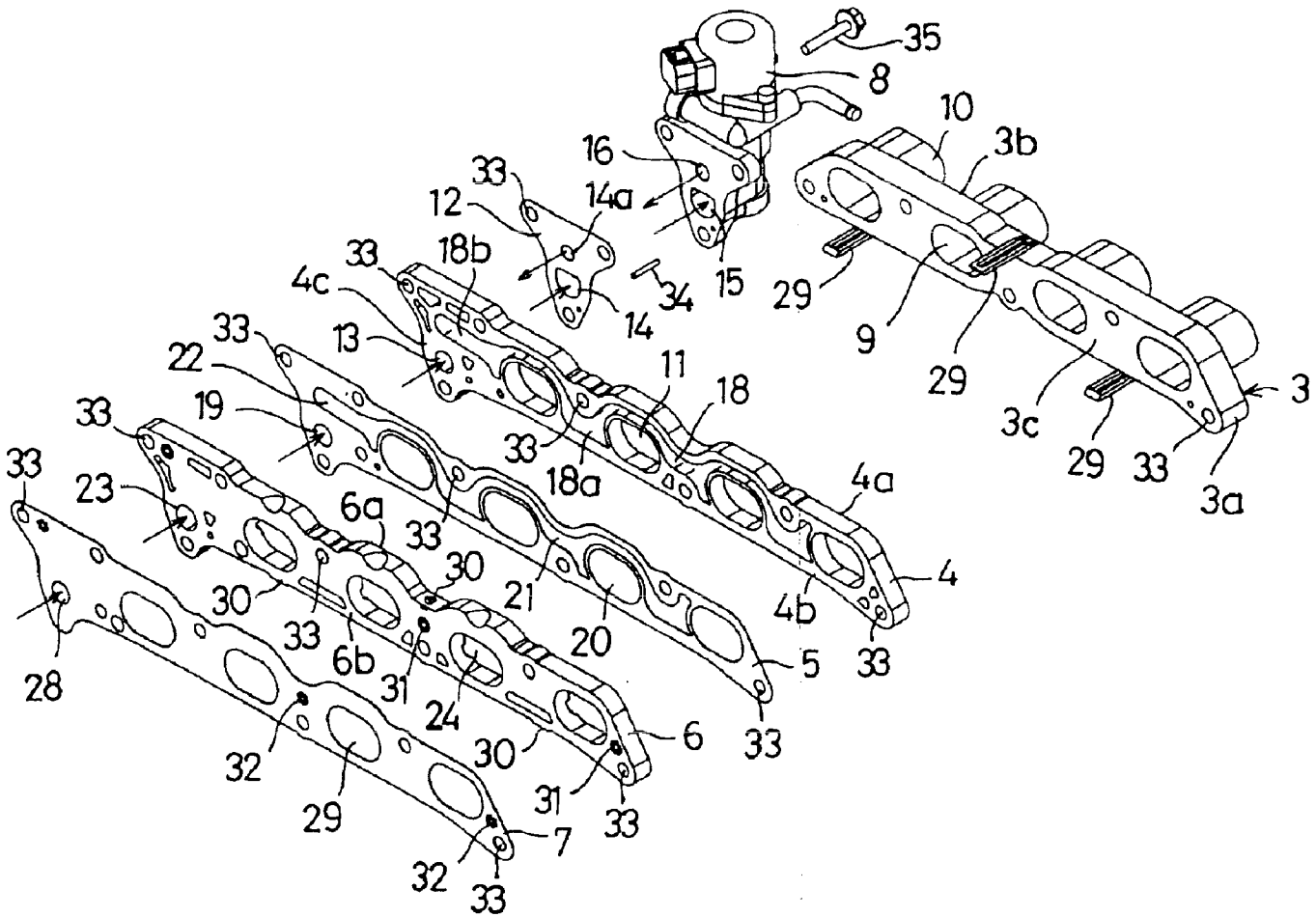
FIG. 3 is an exploded perspective view illustrating the components shown in FIG. 2.
Figure 4A:
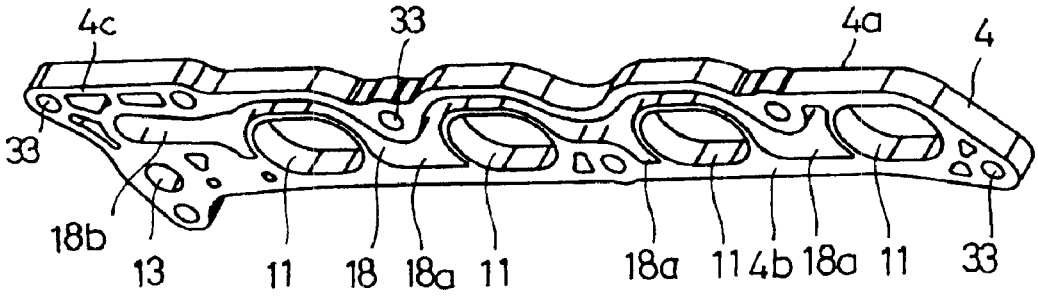
FIG. 4A is an enlarged perspective view illustrating a first plate shown in FIG. 3.
Figure 4B:
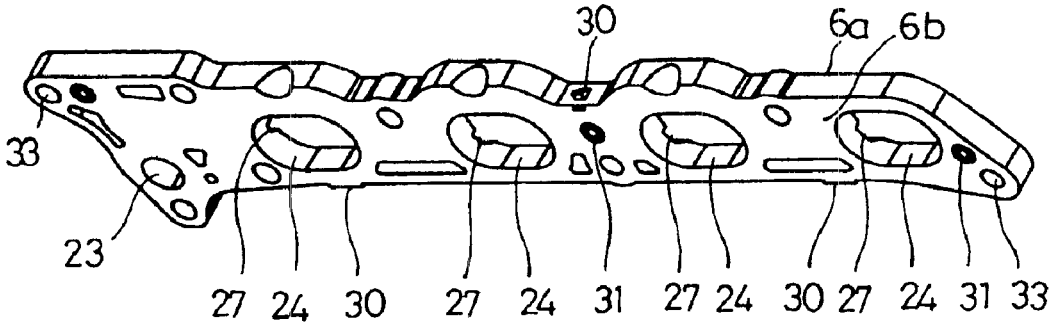
FIG. 4B is an enlarged perspective view illustrating a second plate shown in FIG. 3.

The flange portion 3*a* of the intake manifold 3 is integrally formed therein at its upper and lower surfaces and fixed thereto with snap pins 29 which are made of resin so as to be elastic and which are projected rearward. When the first plate 4, the first metal gasket 5 and the second plate 6 are superposed on the flange portion 3*a* of the intake manifold 3, as shown in FIG. 2, the distal ends of the snap pins 29 are resiliently locked to snap pawls 30 which are formed on the upper and lower surfaces of the second plate 6, and accordingly, and thus, they are temporarily fixed together in the condition.

It is noted that the second metal gasket 7 is temporarily fixed in such a way that pins 31 which are formed protrusively on the rear surface 6*b* side of the second plate 6 are set into pin insertion holes which are formed in the second metal gasket 7 at positions aligned with the pins 31 and are then press-fitted in toothed washers 32 which are provided around the pin insertion holes.

It is noted the above-mentioned components are formed therein with holt holes 33 for permanently fixing them.

Next, explanation will be made of the temporarily fixing of these components.

The first plate 4, the first metal gasket 5 and the second plate 6 are superposed, in the mentioned order, on the rear surface 6*b* side of the flange portion 3*a* of the intake manifold 3, as shown in FIG. 2. After this superposition, the snap pins 29 provided on the flange portion 3*a* of the intake manifold 3 are snap-fitted onto the snap pawls 30 formed on the second plate 6, and accordingly, these components are temporarily fixed in an integral condition. Further, the second metal gasket 7 is superposed on the rear surface 6*b* of the second plate 6 while the toothed washers 32 thereof are press-fitted onto the pins 31, and accordingly, the metal gasket 7 is temporarily fixed to the second plate 6. Thus, these components are formed into an unit body (modularization).

Further, the EGR valve 8 is set to the first plate 4 through the intermediary of the third metal gasket 12 by means of a locating pin 34, and accordingly, the EGR valve 8 can be also integrally incorporated thereto.

The above-mentioned components are conveyed to an engine assembling station (engine firm) in the above-mentioned temporarily fixed condition. Since these components are formed in a one unit body during the conveyance, the conveyance can be facilitated.

Further, in the engine assembling station, bolts are inserted through these components held in the temporarily fixed condition, and are fastened to the cylinder head 2, and accordingly, these components are also assembled to the cylinder head 2. The EGR valve 8 is attached thereto by a bolt 35. At this stage, since the components are formed in an one unit body (modularization), the man-hours for the assembly can be reduced in comparison with such a case that these components are assembled one by one, thereby it is possible to enhance the productivity.

When the engine is driven in such a condition that these components are assembled to the cylinder head 2, EGR gas extracted from the cylinder head 2, flows into the EGR valve 8 after flowing through the EGR gas passages 28, 23, 19, 13, 14 and 15 in the mentioned order, and accordingly, the flow rate thereof is controlled in the EGR valve 8. Further, the EGR gas flows through the EGR gas outflow passages 16, 14*a*, and then flows from the EGR intake port 17 formed in the first plate 4 into the EGR gas intake passages 18*b*, 25*b* formed in the first and second plates 4, 6. Thereafter, it flows through the EGR gas passages 18, 25 formed in the first and second plates 4, 6, and is then discharged and distributed into the intake passages 24 through the EGR gas outlet ports 27 formed in the recesses 25*a* of the second plate 6 and located at the lowest portions thereof.

During the above-mentioned flowing of the EGR gas, when condensed water from steam in the EGR gas attaches to the EGR gas intake passages 18*b*, 25*b*, it flows down into the recesses 18*a*, 25*a* since the EGR gas intake passages 18*b*, 25*b* are inclined downward to the downstream side, thereby it is possible to prevent the condensed water from collecting.

Further, condensed water which attaches to the EGR inflow passages 18, 25 flows down into the recesses 18*a*, 25*a*, thereby it is also possible to prevent the condensed water from collecting.

Further, the condensed water having flown down in the recesses 18*a*, 25*a* is carried away by the stream of the EGR gas, and is then discharged into the intake passages 24, and accordingly, it is prevented from collecting in the recesses 18*a*, 25*a*.

Further, the bottom surfaces 25*c* of the recesses 25*c* are formed so as to be inclined downward on the front surface 6*a* side in the engine assembly condition, and are formed in its lowest portions with the EGR gas outlet ports 27, and accordingly, the condensed water can be surely drained. That is, if both plates 4, 6 are assembled to the cylinder head 2, being inclined with respect to the horizontal plane L, as shown in FIG. 7C, the bottom surfaces 18*c*, 25*c* of both recesses 18*a*, 25*a* are sloped downward toward the EGR gas outlet ports 27, thereby it is possible to carry out drainage of the condensed water more surely.

Next, explanation will be made of the relationship among the EGR gas inflow passage 13 in the first plate 4, the communication hole 19 in the first metal gasket 5 and the EGR gas inflow passage 23 in the second plate 6 with reference to FIGS. 8A to 9B.

As mentioned above, in such a configuration that the first plate 4 and the second plate 6 are provided, it is required to prevent the condensed water from collecting in the EGR inflow passages 13, 23 in the first and second plates 4, 6.

However, should the first metal gasket 5 be arranged out of alignment so that the bottom surface 19*a* of the communication hole 19 formed therein is lower than the bottom surfaces 13*a*, 23*a* of the EGR gas inflow passages 13, 23 formed in both plates 4, 6, as shown in FIGS. 9A, 9B, there would be caused such a problem that the condensed water W collects on the bottom surface 19*a* of the communication hole 19, and accordingly, it cannot be drained, as shown in FIG. 9A.

Thus, according to the present invention, as shown in FIGS. 8A, 8B, there is provided such a configuration that the bottom surface 19*a* of the communication hole 19 in the first metal gasket 5 is lower than the bottom surface 23*a* of the EGR gas inflow passage 23 in the second plate 6, and the bottom surface 13*a* of the EGR inflow passage 13 in the first plate 4 is lower than the bottom surface 19*a* of the communication hole 19 in the first metal gasket 5.

With this configuration, EGR gas flows in the direction of the arrow X, and accordingly, condensed water attaching to the bottom surface 23*a* of the EGR inflow passage 23 in the second plate 6 flows down onto the bottom surface 19*a* on the first metal gasket 5 side, as indicated by the arrow Y. Further, the condensed water attaching to the bottom surface 19*a* flows down onto the bottom surface 13*a* on the second plate 4 side. Thus, the condensed water can be prevented from collecting in the first metal gasket 5 and the second plate 6.

Figure 10:
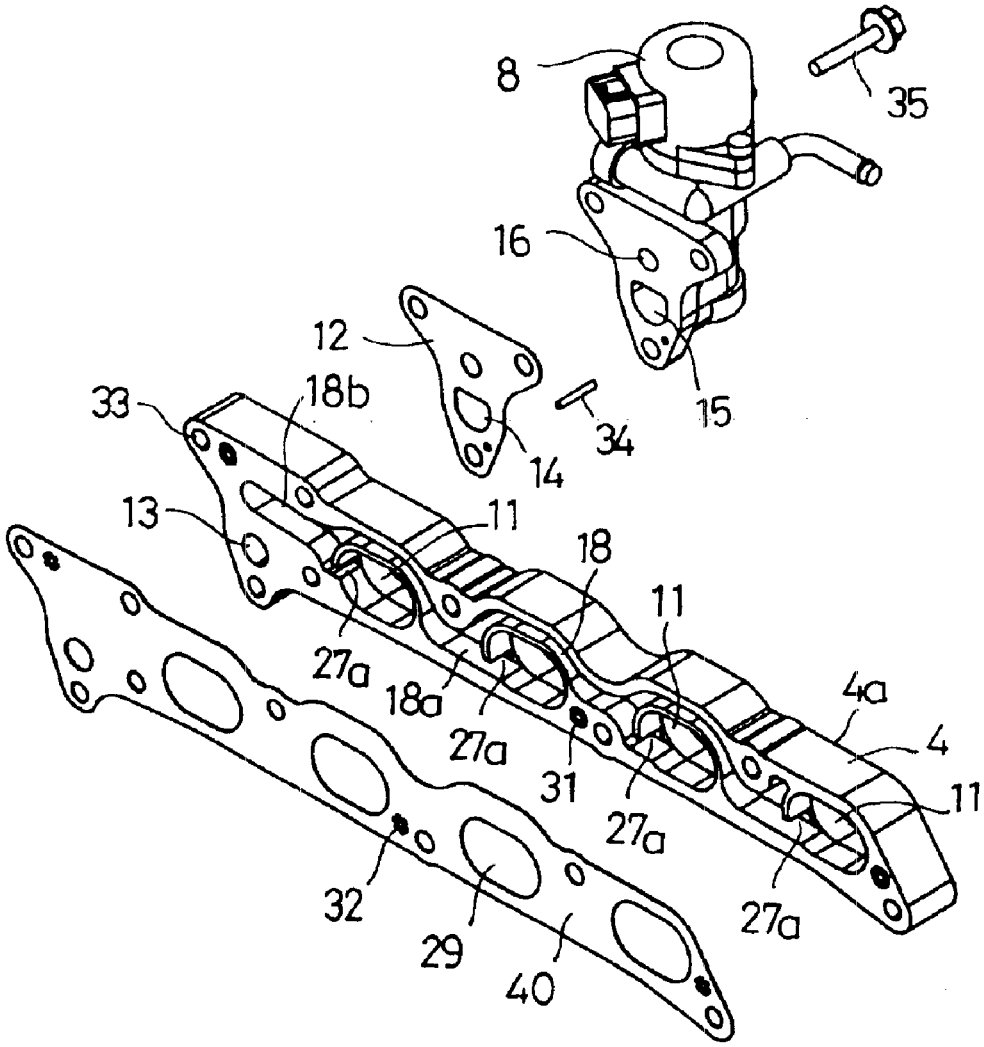
FIG. 10 is an exploded perspective view illustrating a second embodiment according to the present invention.

FIG. 10 shows a second embodiment according to the present invention.

In the second embodiment, EGR gas outlet ports 27*a* are formed in the recesses 18*a* of the EGR gas passage 18 in the first plate 4 of the first embodiment, being located in the lowest portions thereof, and being communicated with the respective intake passages 11, and a metal gasket 40 similar to the second metal gasket 7 is arranged, instead of the first metal gasket 5 of the first embodiment. Further, the metal gasket 40 is temporarily fixed to the first plate 4 by means of the pins 31 and the toothed washers 32 as stated above.

In this second embodiment, the second plate 6 and the first metal gasket 5 in the first embodiment are eliminated, and the rear side of the EGR gas passage 18 in the first plate 4 is closed by the metal gasket 40.

The configuration of the embodiment is the same as that of the first embodiment, except those as mentioned above, and accordingly, like reference numerals are used to denote like parts to those stated above. Thereby, explanation thereto will be omitted.

Even in this second embodiment, EGR gas can prevent the condensed water from collecting in the EGR gas passage 18 in the first plate 4 so as to discharge the condensed water from the EGR gas outlet ports 27*a* into the intake passages 11.

Figure 11:
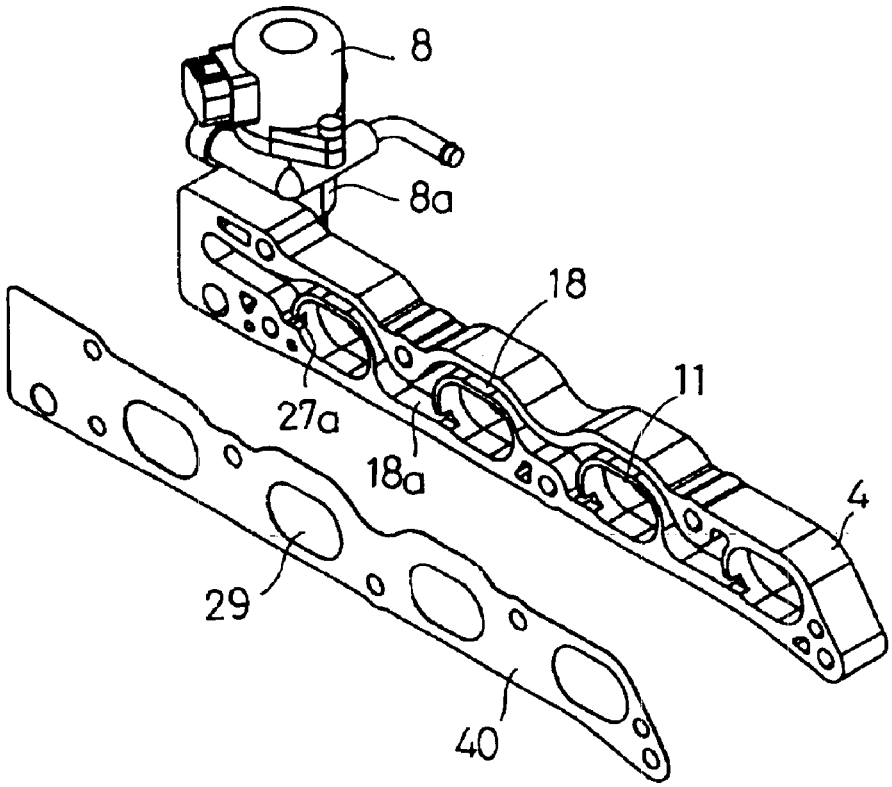
FIG. 11 is an exploded perspective view illustrating a third embodiment according to the present invention.
Figure 12:
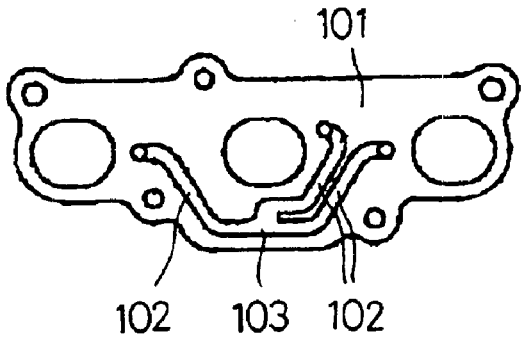
FIG. 12 is a front view illustrating a spacer in a conventional configuration.

FIG. 11 shows a third embodiment according to the present invention.

In the third embodiment, the body housing 8*a* of the EGR valve 8 in the second embodiment is integrally incorporated with the first plate 4, being made of metal.

The configuration of the third embodiment is the same as that of the second embodiment except that mentioned above, and accordingly, like reference numerals are used to denote like parts to those of the second embodiment. Thus, the explanation thereto will be omitted.

In the third embodiment, technical effects and advantages similar to those of the second embodiment can be exhibited, and as well, due to the integral incorporation of the body housing 8*a* of the EGR valve 8 and the first plate 4, the third metal gasket 12 and the bolt 35 can be eliminated, thereby it is possible aim at reducing the cost and facilitating the assembly thereof.

Thus, according to the present invention, condensed water in the plates can be surely discharged into the intake passages, thereby it is possible to prevent the plates from being corroded by the condensed water collecting.

What is claimed is:

1. An exhaust gas recirculation system for an internal combustion engine, in which a plurality of metal plate are interposed between a cylinder head and a resin intake manifold, and an EGR gas passage is formed in the plates, characterized in that, an EGR gas outlet port is formed being located in a lowest portion of the EGR gas passage formed in the plates, being communicated with an intake passage formed in the plates.

2. An exhaust recirculation system as set forth in claim 1, wherein two of said metal plates are provided, one of which has a planar surface formed therein with a recess, and another of which is formed with a recess corresponding to the afore-mentioned recess so as to define the EGR gas passage by these recesses in the combination of these plates, and the EGR gas outlet port is formed in the lowest portion of the EGR gas passage.

3. An exhaust gas recirculation system as set forth in claim 1, wherein the bottom surface of the EGR gas passage is sloped so as to be inclined downward on a side where the EGR gas outlet port is located in a fore and aft direction of the plates.

4. An exhaust gas recirculation system as set forth in claim 2, the bottom surfaces of the recesses which define the EGR gas passage, are sloped so as to be inclined downward on a side where the EGR gas outlet port is located, in a fore and aft direction of the plates.

5. An exhaust gas recirculation system as set forth in claim 1, wherein an EGR valve has a body housing which is integrally incorporated with one of the plates, being made of metal.

6. An exhaust gas recirculation system as set forth in claim 2, wherein an EGR valve has a body housing which is integrally incorporated with one of the plates, being made of metal.

7. An exhaust gas recirculation system as set forth in claim 3, wherein an EGR valve has a body housing which is integrally incorporated with one of the plates, being made of metal.

8. An exhaust gas recirculation system as set forth in claim 4, wherein an EGR valve has a body housing which is integrally incorporated with one of the plates, being made of metal.

* * * * *